US005698078A

United States Patent [19]

Mizukami et al.

[11] Patent Number: 5,698,078

[45] Date of Patent: Dec. 16, 1997

[54] WET NON-WOVEN FABRIC AND METHOD FOR PRODUCING THE SAME

[75] Inventors: Yoshikatsu Mizukami, Osaka; Tsutomu Teshima; Katsumi Agari, both of Houfu; Yutaka Tanaka, Osaka; Hiroko Fukumoto, Houfu, all of Japan

[73] Assignee: Kanebo, Ltd., Tokyo, Japan

[21] Appl. No.: 290,763

[22] PCT Filed: Dec. 15, 1993

[86] PCT No.: PCT/JP93/01818

§ 371 Date: Aug. 12, 1994

§ 102(e) Date: Aug. 12, 1994

[87] PCT Pub. No.: WO94/13881

PCT Pub. Date: Jun. 23, 1994

[30] Foreign Application Priority Data

Dec. 17, 1992 [JP] Japan ..... 4-355648

[51] Int. Cl.[6] ..... D21H 11/00

[52] U.S. Cl. ..... 162/164.1; 604/372

[58] Field of Search ..... 162/164.7, 157.5, 162/146, 157.2, 209, 261, 70, 9, 164.1, 168.7; 604/372

[56] References Cited

U.S. PATENT DOCUMENTS

| | | | |
|---|---|---|---|
| 2,076,991 | 4/1937 | Holgersson et al. | 162/209 |
| 3,889,678 | 6/1975 | Chatterjee et al. . | |
| 4,270,977 | 6/1981 | Hermans et al. | 162/168.1 |

FOREIGN PATENT DOCUMENTS

| | | | |
|---|---|---|---|
| 701174 | 1/1965 | Canada | 162/157.4 |
| 0361842 | 4/1990 | European Pat. Off. | 604/376 |
| 61-113900 | 5/1986 | Japan . | |
| 4-163397 | 6/1992 | Japan . | |

*Primary Examiner*—Brenda A. Lamb

*Attorney, Agent, or Firm*—Flynn, Thiel, Boutell & Tanis, P.C.

[57] ABSTRACT

A wet non-woven fabric comprising a highly water absorptive polymer and pulp and a method for producing the same. Since this wet non-woven fabric is excellent in water absorbing property and uniformity, it can be offered as a thin non-woven fabric.

6 Claims, 1 Drawing Sheet

WET NON-WOVEN FABRIC AND METHOD FOR PRODUCING THE SAME

DETAILED DESCRIPTION OF THE INVENTION

1. Field of the Invention

This invention relates to a wet non-woven fabric and a method for producing the same, and, more specifically, to a wet non-woven fabric having an excellent water absorption property and a method for producing the same.

2. Prior Art

Non-woven fabrics having an excellent water absorption property have already been commercialized. Most of them are dry non-woven fabrics. To improve their water absorption percentage, absorptive polymer fibers or particles are contained in the dry non-woven fabrics. In the paper making case where the-absorptive polymer fibers or particles are mixed with a wet non-woven fabric, as an absorptive polymer fiber or particle generally used has a diameter as large as 0.5 to 2.0 mm, the water absorptive polymer fiber or particle swells to approximately 1000 times its original size and has a diameter of several millimeters at mixing with water. Consequently, the water absorptive polymer fiber or particle has the disadvantage that it excludes other fibers at the time of paper-forming and falls off from the non-woven fabric when it is dried after paper-making.

Furthermore, the water absorptive polymer fiber or particle has another disadvantage that an increase in its mixing ratio with the fabric lowers the strength of the wet non-woven fabric. Therefore, to overcome this disadvantage, the absorptive polymer fiber or particle is dispersed between layers of a laminate. However, this method requires additional cost for stacking layers, thus boosting costs.

Japanese Patent Publication No. 55202/1986 discloses a method which comprises the steps of impregnating a non-woven fabric with a monomer before polymerization and then polymerizing the monomer. Since the method requires an intricate apparatus, a large amount of initial investment is necessary, also inviting an increase in costs.

DESCRIPTION OF THE INVENTION

An object of the invention is to provide a wet non-woven fabric having a uniform water absorption property.

Another object of the invention is to provide a method for producing the wet non-woven fabric of the invention with ease and at a low cost.

Other objects and advantages of the invention will become apparent in the following description.

Firstly, according to the present invention, the above-mentioned objects and advantages of the invention are attained by a wet non-woven fabric which comprises (A) a highly water absorptive polymer in an amount of 5 to 60% by weight and (B) pulp in an amount of 40 to 95% by weight, based on the total weight of the components (A) and (B).

Secondly, according to the present invention, there is provided a method for producing a wet non-woven fabric which comprises the steps of:

wet pulverizing at least one of a highly water absorptive polymer fiber and particle while it is swollen with water;

mixing it with pulp; and making paper of the resulting mixture;

or pulverizing at least one of a highly water absorptive polymer fiber and particle while it is swollen with water, together with pulp and beating them; and making paper of the resulting mixture.

BRIEF DESCRIPTION OF THE DRAWING

FIG. 2 is an enlarged view of FIG. 1. Wrinkled portions are pulp and non-wrinkled portions are a highly water absorptive polymer.

MOST PREFERRED EMBODIMENT OF THE INVENTION

Figure 1:
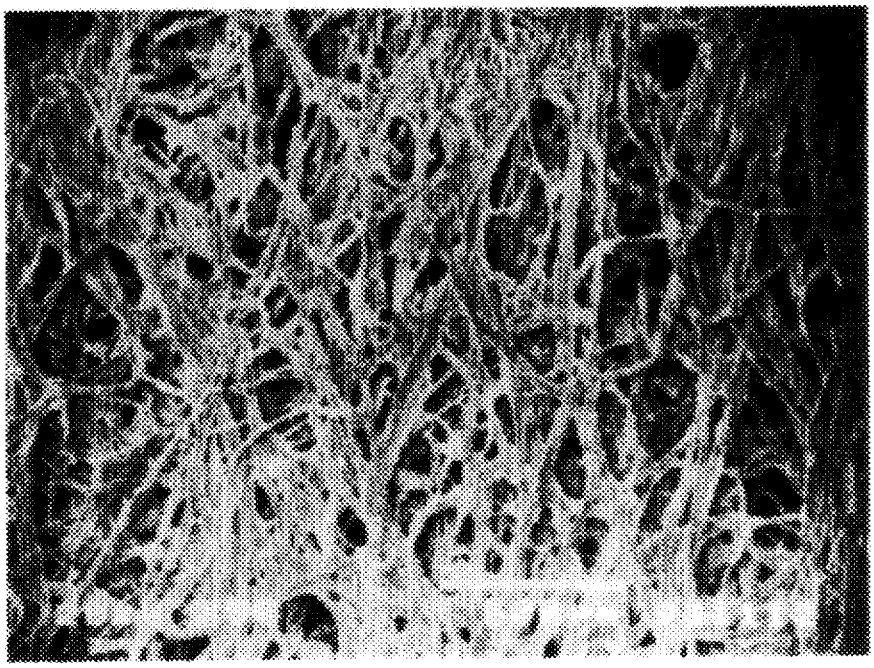
FIG. 1 and FIG. 2 are SEM photos of a wet non-woven fabric obtained in Example 2.
Figure 2:
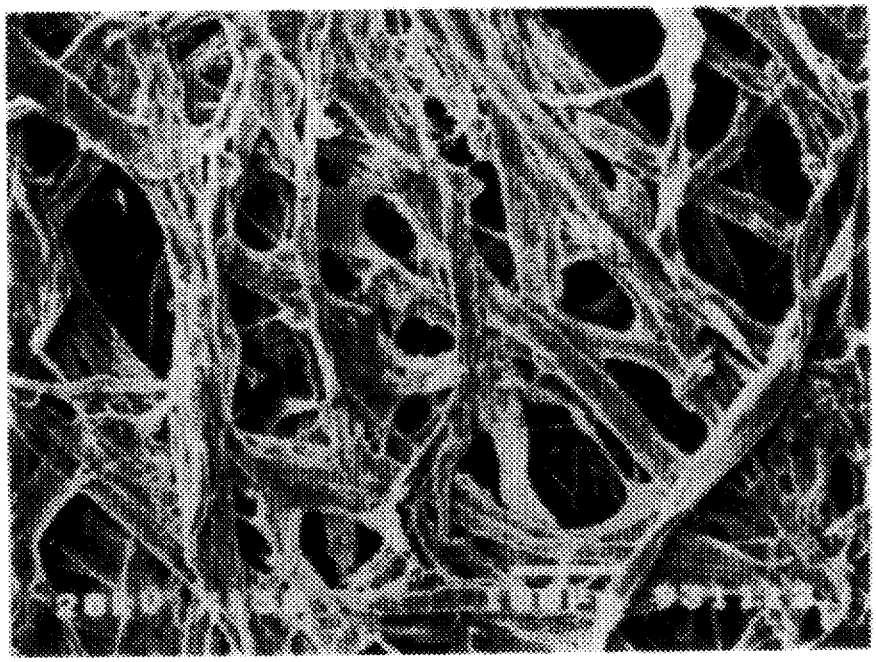

The highly water absorptive polymer used in the present invention is preferably a copolymer of a monomer having a carboxylic acid group, a monomer having a hydroxyl group that can form an ester bond upon reaction with a carboxylic acid group, and a monomer having an alkali metal salt carboxylate group. The polymer has a crosslinking structure and exhibits the water absorption ability to absorb 1200% by weight or more and less than 3000% by weight of physiological saline solution.

Examples of the monomer having a carboxylic acid group include acrylic acid (abbreviated as AA hereinafter), methacrylic acid, maleic acid and so forth. They may be used alone or in combination of two or more.

Examples of the monomer having a hydroxyl group include hydroxyethylmethacrylate (abbreviated as HEMA hereinafter), hydroxypropylmethacrylate, hydroxyethylacrylate, hydroxypropylacrylate, glyceryl monomethacrylate, glyceryl monoacrylate, and so forth. They may be used alone or in combination of two or more.

Examples of the monomer having an alkali metal salt carboxylate group include alkali metal salts of AA, methacrylic acid, maleic acid and so forth. Examples of the alkali metal include sodium (abbreviated as Na hereinafter), potassium and so forth. They may also be used alone or in combination of two or more.

The monomer having a hydroxyl group is preferably used in an amount not more than the equivalent mol of the monomer having a carboxylic acid group. It is advantageous to use the monomer having a hydroxyl group in an amount of at least 0.5% by weight based on the total weight of the monomer having a carboxylic acid group, the monomer having a hydroxyl group and the monomer having an alkali metal salt carboxylate group. Below 0.5% by weight, the crosslinking density of the resulting copolymer may be too small.

The weight ratio of the monomer having a carboxylic acid group to the monomer having an alkali metal salt carboxylate group is preferably in the range from b 1/1to 1/10. The total of the monomer having a carboxylic group and the monomer having an alkali metal salt carboxylate group is preferably in the range from 70 to 99.5% by weight, more preferably from 80 to 95% by weight, based on the total weight of these monomers and the monomer having a hydroxyl group. Below 70% by weight, the saline solution absorption percentage of the resulting copolymer may be insufficient, which is not desirable.

In addition to the above-mentioned monomers, other vinyl monomers such as vinyl acetate (abbreviated as VA hereinafter) and acrylonitrile may be used to provide the copolymer with plasticity. The amount of monomer for plasticizing the copolymer is preferably not more than 30 by weight.

The polymerization method of the highly water absorptive polymer used in the present invention is not limited specifically. Water-base polymerization may be used if the monomer composition is water soluble. Generally used sodium persulfate and other suitable substances may be used as a polymerization initiator.

The spinning method for obtaining the highly water absorptive polymer fiber used in the present invention is preferably generally used dry spinning. In the case of wet spinning, an organic solvent must be used because water cannot be used as a coagulant. After dry spinning, the highly water absorptive polymer is drawn to at least 1.3 times by dry heating while it contains not less than 10% by weight of water, and then subjected to crosslinking treatment by dry heating. Thereafter, the resulting fiber is suitably crimped and cut. When the fiber is not drawn to 1.3 times or more while it contains not less than 10% by weight of water, the strength of the resulting fiber would be insufficient. Although a fiber having a large molecular weight absorbs a large quantity of water, it is hard to be drawn because of its large molecular weight, and the strength of the fiber tends to decrease.

The highly water absorptive fiber produced by the above-mentioned method and used in the present invention preferably absorbs 1200% by weight or more and less than 3000% by weight of a physiological saline solution, more preferably 1800% by weight or more and less than 3000% by weight. Above 3000% by weight, the fiber strength is apt to deteriorate.

Since the above-mentioned highly water absorptive fiber exhibits excellent resistance to flame, it can provide a wet non-woven fabric with resistance to flame even if it is mixed with pulp in an appropriate amount.

The average diameter of the highly water absorptive fiber used in the present invention when it is dry is preferably not more than 50 μm, more preferably not more than 20 μm. Above 50 μm, the quality of the resulting wet non-woven fabric formed into paper deteriorates. That is, the wet non-woven fabric to be produced deteriorates in uniformity and strength.

Furthermore, the highly water absorptive fiber used in the present invention is preferably not more than 20 mm in length.

Examples of the highly water absorptive polymer particle used in the present invention include commercially available sodium polyacrylate-base, graft polymerized starch-base and polyethylene oxide-base particles, but the highly water absorptive particle used in the present invention is not limited to these.

There are great differences in size among these commercially available highly water absorptive polymer particles: a large one is almost 1 mm in diameter. When these particles absorb pure water and swell, they become approximately 10 times larger in diameter and, hence, they are not suitable for the formation of paper. Even if the highly water absorptive polymer is pulverized directly into powders to reduce its size, the powders aggregate and become a big mass when they are dispersed into water. When it is pulverized into powders while it is dry, the powders are apt to easily absorb moisture because of their large surface areas. Therefore, they aggregate in storage, thus making it difficult to handle them.

According to the method of the present invention, the highly water absorptive polymer fiber or particle is wet pulverized while it is swollen with water. Thereby, the fiber or particle does not aggregate but is uniformly dispersed. The average diameter of the pulverized highly water absorptive fine polymer in the form of an amoeba preferably falls below 50 μm, more preferably below 20 μm, when it is dry. Above 50 μm, the quality of the produced wet non-woven fabric deteriorates. The smaller the average diameter of the polymer, the better texture it achieves. In other words, the uniformity, strength and other factors of the produced wet non-woven fabric deteriorate. For underwater pulverization, a mixer with a blade can be used. When the concentration of pulp and the polymer of fiber at the time of pulverization is higher than that at the time of forming paper, improved pulverization efficiency can be achieved. After the highly water absorptive polymer swells, its compatibility with pulp is improved. The above-mentioned highly water absorptive fiber which exhibits adhesion may be used in conjunction with the highly water absorptive fine polymer particle which exhibits adhesion. When the average diameters of the highly water absorptive fiber and the highly water absorptive polymer particle are reduced, their water absorption percentages for highly viscous substances such as blood and substances containing a solid matter, for example, are improved.

In the method of the present invention, the wet pulverized matters of the above-mentioned highly water absorptive polymer are then mixed with pulp, and paper is formed of the resulting mixture.

That is, the wet non-woven fabric of the present invention can be obtained by dispersing highly water absorptive fibers and/or highly water absorptive fine polymer particles into a pulp slurry which has been suitably beaten to control its freeness, forming paper with a paper-forming machine of a short net type or a long net type and drying paper. For the formation of paper, it is preferred that vibrations are given to the paper forming net. The highly water absorptive fiber and/or the highly water absorptive fine polymer particle swells in the paper-forming step, but changes into an amoeba-like form when it is dried in the paper. However, both of them still exhibit the same water absorption property as that of the original.

The pulp used in the present invention is not limited to any particular type. NBKP, LBKP and other pulps that are generally used may be used, but the present invention is not limited to these. The wet non-woven fabric of the present invention contains at least 40% by weight of pulp. Below 40% by weight, paper-forming is difficult and it is not preferable economically.

According to another method of the present invention, at least one of the highly water absorptive fiber and particle while it is swollen with water may be pulverized together with pulp and beaten, and then paper is made.

To produce the wet non-woven fabric of the present invention, generally used additives such as a paper strength enhancing agent, sizing agent, pigment, flame retardant and antibiotic agent and a binder fiber may be used in such amounts that do not significantly impair the water absorption percentage.

Thus, according to the method of the present invention, the above-mentioned wet non-woven fabric of the present invention can be produced.

The water absorptive wet non-woven fabric of the present invention contains 5 to 60% by weight of a highly water absorptive polymer. Although different by each application purpose, when the content is below 5% by weight, the water absorption ability of the fabric is insufficient for practical use. On the other hand, when it exceeds above 60% by weight, paper formation is difficult. From a viewpoint of water absorption and operation efficiency, the highly water absorptive polymer content of the wet non-woven fabric is preferably in the range of 10 to 30% by weight.

When the wet non-woven fabric of the present invention is observed through an electron microscope, the highly water absorptive polymer, for example, adheres to the pulp in an amoeba-like form.

Since the wet non-woven fabric of the present invention increases in volume when it swells, it may be used as a water and vapor absorbing packing material with an excellent effect.

Furthermore, the wet non-woven fabric of the present invention may contain fibers (such as polyester, polyethylene and rayon) which can be formed into paper, other than the highly water absorptive fiber, the highly water absorptive fine polymer particle, and pulp.

Moreover, the wet non-woven fabric of the present invention may be laminated or coated with a film, and the resulting fabric can be printed by gravure or other printing technique.

Since the water absorptive wet non-woven fabric of the present invention is excellent in not only water absorption property but also uniformity, it can be offered as a thin water absorptive non-woven fabric.

EXAMPLES

The present invention is described in more detail with reference to examples.

The "%" in the examples indicates "wt %" unless specifically indicated.

The physiological saline solution absorption percentages of the highly water absorptive fiber and the highly water absorptive fine polymer particle were measured according to DIN 53814. As for the composition of the highly water absorptive fiber, its alkali metal salt content was measured by means of fluorescent. X-ray analysis.

A sample dried in vacuum was measured for monomer composition by IR and for polymerization rate by Iatroscan MK5 (TLC/FID). The percentages of the highly water absorptive fiber and the highly water absorptive fine polymer particle contained in the fabric were obtained by determining the alkali metal by means of a fluorescent X-ray or a carboxyl group by means of IR. The strength of the fiber was measured according to JIS L1015. The average particle diameter of the water absorptive polymer which was pulverized when it was dry was obtained by the image analysis of its SEM photo.

Production Example 1

Polymerization compositions shown in Table were subjected to aqueous solution polymerization for 4 hours at a monomer-concentration of 15% and a temperature of 55° C., using sodium persulfate as a polymerization initiator. As the result of measurement by means of TLC, there was no peak in the monomer. It was observed that the polymerization rate was subsantially 100%. Hence, the polymerization compositions of the resulting polymers coincide with those of charges.

The obtained polymer dope was then concentrated and its viscosity was adjusted until it reached nearly 90 poise at 50° C. In the same manner as conventional dry spun yarn, the polymer dope was ejected into a dry hot nitrogen stream for spinning, and dried. The yarn containing 20% of water content was extended to 1.5 times by dry heating at 100° C. After the yarn was crimped with a gear crimper, it was subjected to dry crosslinking treatment for 5 minutes at 120° C. and cut to obtain a highly water absorptive fiber of 10 denier with a length of 5 mm. The physiological saline solution absorption percentage of the thus obtained highly water absorptive fiber is shown in Table 1.

TABLE 1

| Composition No. | Polymerization composition (wt %) AA | AANa | HEMA | VA | Physiological saline solution absorption percentage (wt %) |
|---|---|---|---|---|---|
| 1 | 6 | 64 | 1 | 29 | 1650 |
| 2 | 20 | 79.5 | 0.5 | — | 2640 |
| 3 | 20 | 75 | 5 | — | 2510 |
| 4 | 30 | 69.7 | 0.3 | — | 3950 |
| 5 | 5 | 55 | 5 | 35 | 1090 |

Note)
AA: Acrylic acid, AANa: Sodium acrylate
HEMA: Hydroxyethylmethacrylate
VA: Vinyl acetate The mechanical strength of the resulting fiber was not less than 1 gr/denier and could be subjected to a carding. Composition No. 4 had a high water absorption percentage, but was insufficient in crossinking and partly dissolved in water. Composition No.5 had an insufficient water absorption percentage.

Examples 1 to 5 and Comparative Examples 1 and 2

The highly water absorptive fiber of composition No.2 prepared in Production Example 1 was wet pulverized, mixed with NBKP pulp which had been beaten to a freeness of 300 ml and formed into paper to obtain a basis weight of 100 gr/m$^2$ at mixing ratios of Table 2. The water absorption percentages of the obtained wet non-woven fabrics are shown in Table 2. At the time of paper formation, 0.2% by weight of a paper strength enhancing agent (SUMIRETS 607, manufactured by Sumitomo Chemical Co. Ltd) was added to the pulp. In Comparative Example 1, the paper strength was insufficient. Furthermore, in Comparative Example 2, the water absorption percentage was low.

TABLE 2

| | Mixing ratios of wet non-woven fabric (wt %) Highly water absorptive fiber | Pulp | Physiological saline solution absorption percentage (wt %) |
|---|---|---|---|
| Example 1 | 5 | 95 | 135 |
| 2 | 10 | 90 | 210 |
| 3 | 30 | 70 | 370 |
| 4 | 50 | 50 | 580 |
| 5 | 60 | 40 | 680 |
| Comparative Example 1 | 65 | 35 | 730 |
| 2 | 3 | 97 | 80 |

Example 6 and Comparative Example 3

In the same manner as in Example 5, a water absorptive polymer particle (SUET IM-5000D, manufactured by Sanyo Chemical Industries, Ltd.) was used in place of the highly water absorptive fiber and pulverized at a concentration of 1.0% with a mixer. After it was confirmed by an SEM that the average diameter of the pulverized water absorptive fine polymer particle fell below 50 μm, a predetermined amount of the polymer was mixed with pulp and paper was made of the resulting mixture while vibrations were given to the net. The water absorption percentage of the obtained wet non-woven fabric was 960%. The wet non-woven fabric had a good texture and uniformity.

As Comparative Example, a non-woven fabric prepared without pulverizing the water absorptive polymer was inferior in uniformity. When vibrations were not given to the net at the time of paper formation, the water filtering rate significantly lowered. The obtained wet non-woven fabric was inferior in both uniformity and texture.

Example 7

The highly water absorptive fiber used in Example 1 and the water absorptive fine polymer particle used in Example 6 were mixed together in an equal amount. Thirty (30) parts by weight of this mixture and 70 parts by weight of pulp were used to produce a wet non-woven fabric in the same manner as in Example 6. The resultant wet non-woven fabric had a water absorption percentage of 530 and was excellent in both texture and uniformity.

What is claimed is:

1. A wet non-woven fabric comprising a paper made of a mixture of:

(A) a highly water absorptive polymer in an amount of 5 to 60% by weight; and (B) pulp in an amount of 40 to 95%, wherein said % by weight is based on the total weight of (A) and (B) and said highly water absorptive polymer is a copolymer of a monomer having a carboxylic acid group, a monomer having a hydroxyl group that can form an ester bond upon reaction with a carboxylic acid group and a monomer having an alkali metal salt carboxylate group, the amount of said monomer having a carboxylic acid group and said monomer having an alkali metal salt carboxylate group being in the range of from 70 to 99.5% by weight, based on the total weight of the three monomers.

2. A wet non-woven fabric according to claim 1, wherein said highly water absorptive polymer adheres to said pulp.

3. A wet non-woven fabric according to claim 1, wherein said highly water absorptive polymer has a crosslinking structure and ability to absorb 1200% by weight or more and less than 3000% by weight of a physiological saline solution.

4. A wet non-woven fabric according to claim 1, wherein the monomer having a carboxylic acid group is at least one member selected from the group consisting of acrylic acid, methacrylic acid and maleic acid, the monomer having a hydroxyl group is at least one member selected from the group consisting of hydroxyethylmethacrylate, hydroxypropylmethacrylate, hydroxyethylacrylate, hydroxypropylacrylate, glyceryl monomethacrylate and glyceryl monoacrylate and the monomer having an alkali metal salt carboxylate group is at least one member selected from the group consisting of an alkali metal salt of acrylic acid, an alkali metal salt of methacrylic acid and an alkali metal salt of maleic acid.

5. A wet non-woven fabric according to claim 1, wherein the monomer having a carboxylic acid group is acrylic acid, the monomer having a hydroxyl group is hydroxyethylmethacrylate and the monomer having an alkali metal salt carboxylate group is sodium acrylate.

6. A wet non-woven fabric according to claim 5, wherein said polymer additionally contains vinyl acetate.

* * * * *